United States Patent [19]

Lind

[11] 4,397,489

[45] Aug. 9, 1983

[54] LEVER ADAPTER FOR DOOR KNOB

[76] Inventor: Willard H. Lind, 24 Shady Hill Rd., Weston, Mass. 02193

[21] Appl. No.: 219,816

[22] Filed: Dec. 22, 1980

[51] Int. Cl.[3] ..... E05C 19/18

[52] U.S. Cl. ..... 292/347; 292/336.3; 292/DIG. 2

[58] Field of Search ..... 292/347, 1, 336.3, DIG. 2, 292/357

[56] References Cited

U.S. PATENT DOCUMENTS

| | | | |
|---|---|---|---|
| 286,614 | 10/1883 | Hughes | 292/357 |
| 2,756,088 | 7/1956 | Sutter | 292/DIG. 2 |
| 2,808,282 | 10/1957 | Peoples | 292/DIG. 2 |
| 3,827,739 | 8/1974 | Overholser | 292/DIG. 2 |
| 4,007,956 | 2/1977 | Harris et al. | 292/DIG. 2 |
| 4,223,931 | 9/1980 | Neary | 292/DIG. 2 |
| 4,285,536 | 8/1981 | McCoy et al. | 292/DIG. 2 |

*Primary Examiner*—Richard E. Moore

[57] ABSTRACT

An adapter for providing a lever attachment to a round door knob has a hollow threaded cylinder fitted with a lever which cylinder slides over the knob and is frictionally secured to the knob by compressing the knob between one end of the cylinder and a tightened split ring threaded into the other end of the cylinder. Elastomeric material placed on either or both sides of the knob increase the friction and prevent slipping of the adapter on the knob after tightening.

18 Claims, 6 Drawing Figures

LEVER ADAPTER FOR DOOR KNOB

BACKGROUND OF THE INVENTION

This invention relates to lever type door knobs, and more particularly to an adapter for retrofitting conventional door knobs with a lever.

Because of the desire to assist the handicapped in their access to public facilities, efforts are being exerted through laws and regulations to make such access a reality by requiring the construction of ramps, elevators, toilet facilities, etc. suitable for use by the handicapped. Included among these requirements is that door knobs be of the lever type so that a door may be opened by a person having less manual dexterity than is required to turn a conventional round knob. Unfortunately, the cost of replacing each round door knob with a lever is much greater than might be expected because not only must the round knob be replaced, but also the inner mechanism of the door lock. The inner mechanism must be modified because the turning force produced by the off-axis weight distribution of the handle portion causes the lock mechanism designed for a round knob to either completely or partially open the door lock because the spring which holds the tongue of the lock in the extended position (the locking position) is too weak to withstand the turning force produced by the lever. Therefore, for retrofitting a round knob type of door latch, not only must the knob be replaced by a lever, but also the spring must be replaced by a stiffer spring or if that is not possible, the latch mechanism must also be replaced. The cost of replacing round knob combination passage and lock assemblies with a lever handle configuration currently requires the replacement of a passage latch which has stiffer springs to counteract the off axis lever weight and the installation of a separate mortise lock.

SUMMARY OF THE INVENTION

It is therefore a principle object of this invention to provide an adapter which will allow a conventional round knob type of latch to be converted into a lever type without even the necessity of removing the round knob.

It is a feature of the invention that the attachment of the lever to the round knob does not require that the spring of the latch be replaced by one of greater stiffness.

It is a further object of this invention is that only a limited number of sizes of adapters will be required for conversion of the vast majority of round knobs of different diameters, thicknesses and profiles such as spherical, elliptical, tulip, inverted tulip, double tulip, etc.

These objects and features of the invention are achieved by providing a hollow cylinder which slips over the round knob and is secured to the knob. The cylinder has an attached handle which projects at a right angle to the axis of the cylinder. The cylinder has an end which is closed, or alternatively, partially closed. The other end is internally threaded to receive an externally threaded annular ring adapted to slip over the supporting shaft of the knob. Threading the ring into the cylinder causes the cylinder to be secured to the knob to provide a handle-type latch mechanism.

IN THE FIGURES

Other advantages, features and objects of the invention will appear from the following description taken together with the drawings in which.

DETAILED DESCRIPTION OF THE INVENTION

Figure 1:
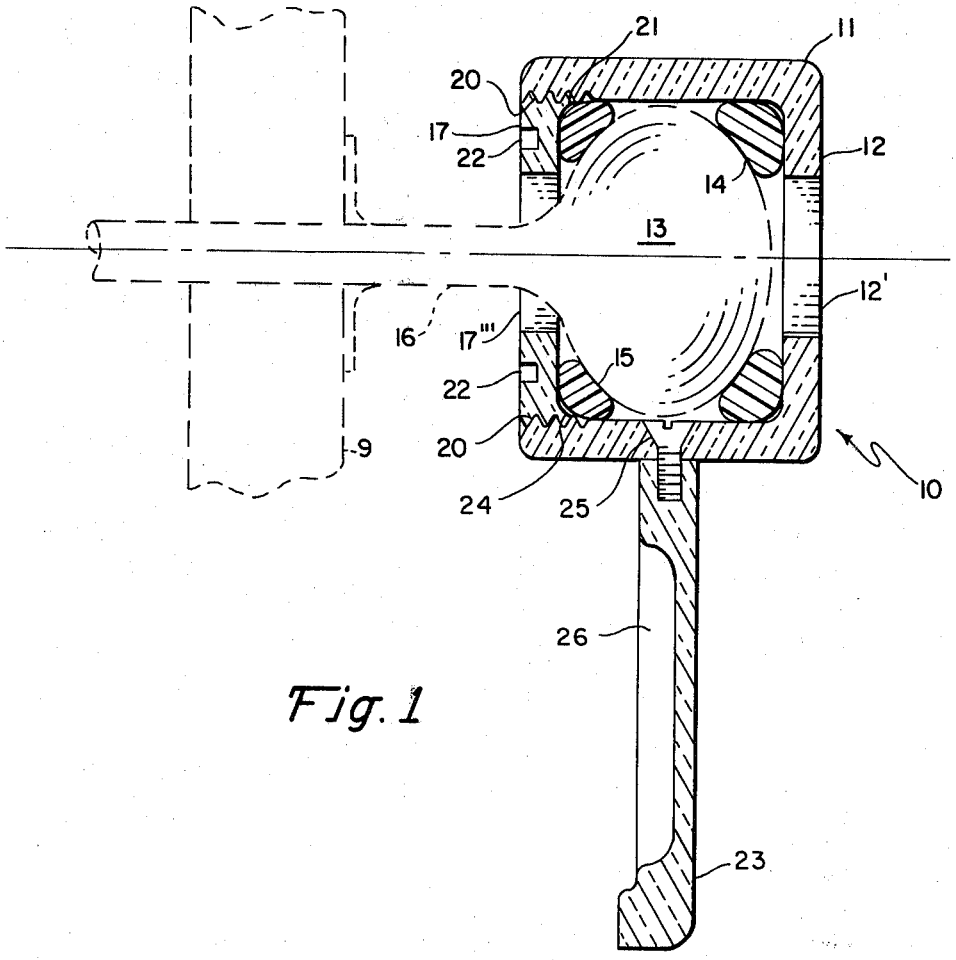
FIG. 1 is a cross-sectional view of the lever adapter of this invention.
Figure 3:
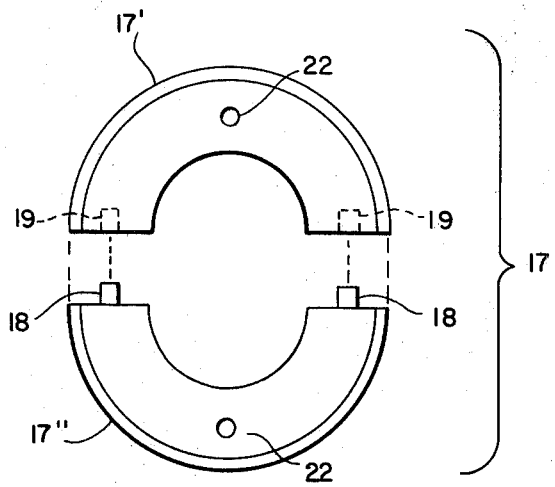
FIG. 3 is a plan view of the split compressor ring.
Figure 2:
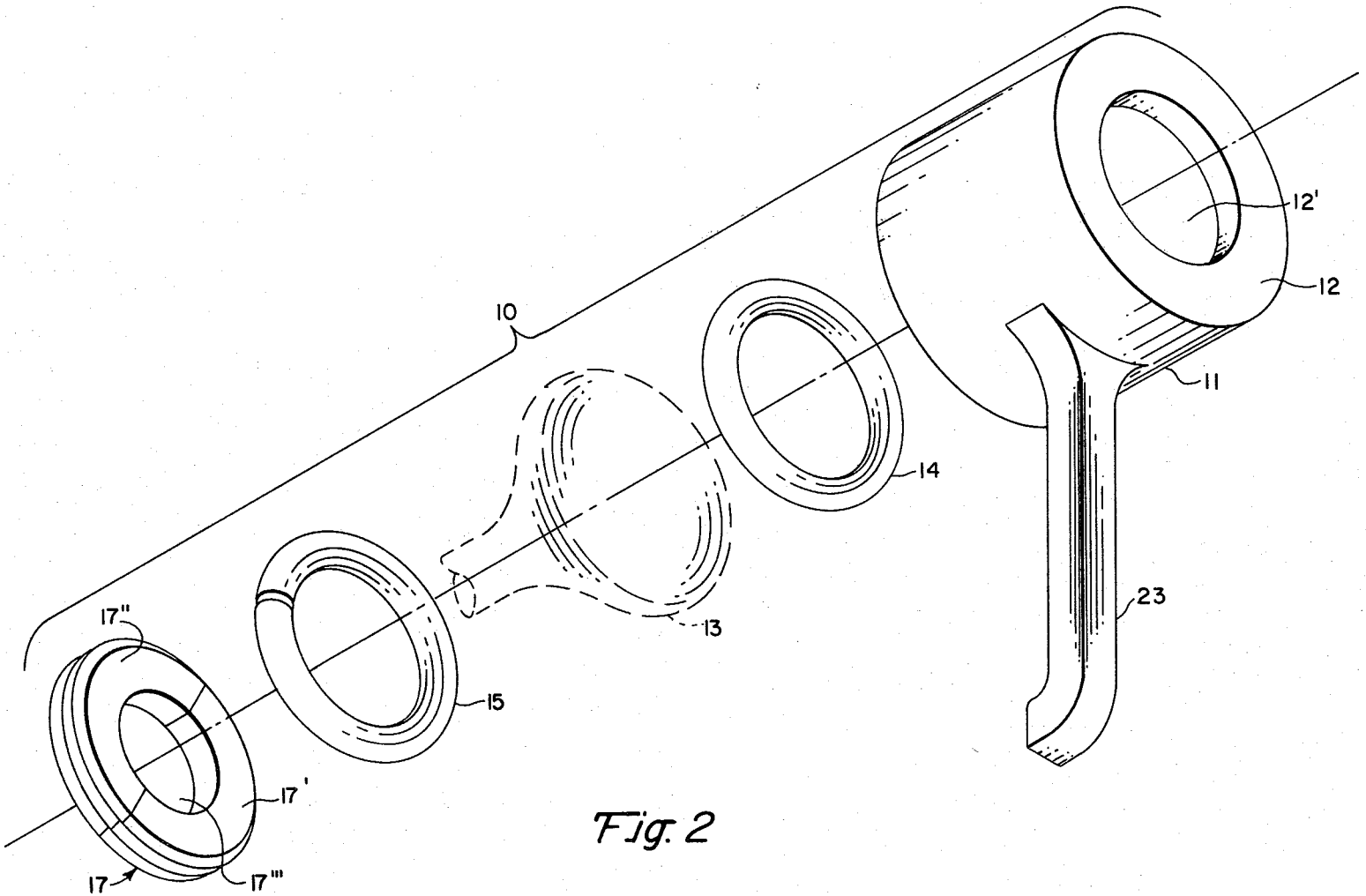
FIG. 2 is an exploded perspective view of the lever adapter.

Referring now to the cross-sectional view of FIG. 1 showing a section of a door 9 with the adapter 10 of the invention attached to the door knob 13 and referring also to the exploded view of the adapter 10 in FIG. 2, there it is seen that adapter 10 comprises an internally threaded cap or cylinder 11 having a collar 12 at one end. The internal diameter of the cylinder 11 is sufficiently large to allow the cylinder to slip over the knob 13. A circular gasket 14 is inserted into the cylinder 11 before the cylinder is placed over the knob 13. The collar 12 may have an axially centered hole 12' to provide access to a keyhole in knob 13 if desired. A second circular gasket 15 which has been severed may be put around the neck 16 of knob 13. Alternatively, if the gasket is sufficiently stretchable, it may be used in its unsevered form by slipping it over the knob 13.

An externally threaded pressure ring 17 is split to allow its placement over the knob neck 16 without disassembly of any part of the latch of which the knob is a part. The ring 17 is split and forms two half-rings 17' and 17''. The pins 18 of half-ring 17'' mate with holes 19 of half-ring 17' to cause the ring 17 to have a continuous thread 20 which allows ring 17 to be threaded into cylinder 11 by its thread 21. The ring 17 has a hole 17''' large enough to allow ring 17 to encircle neck 16. Each half-ring 17', 17'' has an axially directed hole 22 which allows ring 17 to be tightened against knob 13 by a spanner wrench. Substantial force may be exerted in tightening ring 17 in order to prevent the assembled adapter 10 from slipping on knob 13 in normal operation.

The handle 23 is attached to the cylinder 11 by a screw 25. Alternatively, the handle 23 may be attached to the cylinder 11 by an adhesive, such as an epoxy, or by any other suitable means including being formed as a unit with the cylinder 11. The handle 23 which normally assumes a horizontal position when secured to the knob 13 may because of its off-axis weight produce a turning torque on the knob 13. To reduce the turning torque of handle 23 it has a hollowed out portion 26 and is preferably made of a material having small mass. If the turning torque is sufficiently large to partially disengage the latch by turning the knob 13 against the restraining force of a spring contained within the latch, a counterweight may be provided to counter the turning torque of the handle or lever 23. A counterweight may be provided by selection of the material of the half-ring 17' to have a mass substantially greater than that of the half-ring 17''. As an example half-ring 17' may be made of lead whereas half-ring 17'' may be a light-weight plastic. When ring 17 is tightened into cylinder 11, the heavier half-ring would be tightened to a position where it was radially opposite the handle or lever 23.

Alternatively, a counterweight could be attached to the cylinder 11 at a position radially opposite the handle 23. It will be apparent that other counterweighting techniques could be used.

The split ring 17 is preferably formed with an internally beveled portion 24 which provides a radially inwardly directed force on the elastomeric ring 15 to prevent it from being jammed between the threads 20, 21 and thereby making it difficult to exert the necessary amount of frictional force on the knob 13 in order to prevent slipping of the adapter 10.

Figure 4:
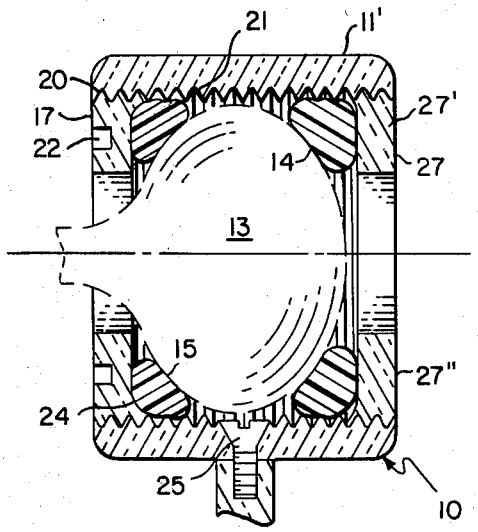
FIGS. 4–6 show cross-sectional views of other embodiments of the invention.
Figure 5:
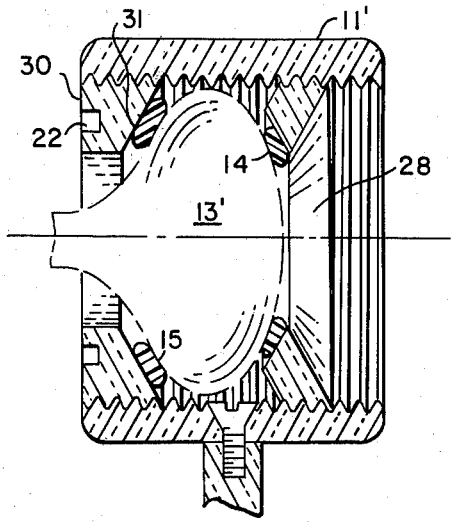
Figure 6:
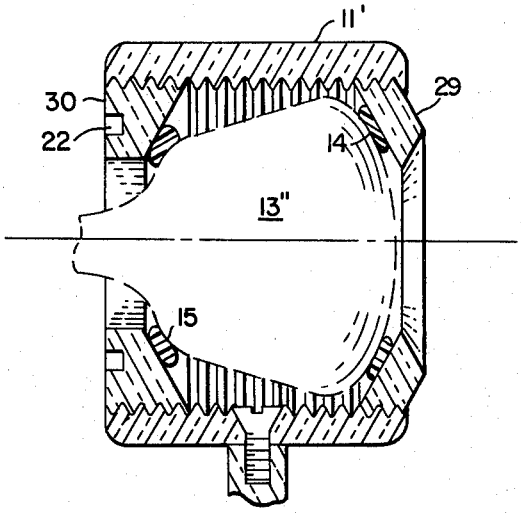

Although cylinder 11 is shown with an integral collar 12 at one end in FIGS. 1 and 2, an alternative embodiment shown in FIG. 4 has a collar 27 which is threaded into the cylinder 11. Collar 27 has a beveled portion 28 to serve a function equivalent to that of bevel 24 of ring 17. Collar 27 may be made of two half or semi-collars 27', 27'', with one being of a denser material and positioned opposite the lever 23 to act as an additional counterweight. Collar 27 does not require spanner wrench holes 22 since it may be hand threaded into cylinder 11 before cylinder 11 is placed over the knob 13. By having the collar 27 removable different configurations of the collar suitable for different shapes of knobs may be inserted into cylinder 11. Collars of different center hole 27''' sizes, different widths and with different bevels may be used as illustrated in FIGS. 5 and 6.

The axial length of the cylinder 11 is designed to accomodate a majority of the usually encountered knob sizes and the radially directed ring 17 and collar 27 of FIGS. 1 and 4 are generally satisfactory. However, where the knob 13'' is unusually long and projects axially beyond the limits which can be accomodated by the radial rings of FIG. 4, the collar 29 (and ring 30) may project outwardly as shown in FIG. 6 where collar 29 has a configuration which allows a larger than ordinary knob 13'' to be contained within the same size cylinder 11 as in FIGS. 1 and 4. Conversely, the collar 29 may be inserted in the opposite direction to project inwardly as shown in FIG. 5 to accomodate a knob 13' with a very shallow axial length. Ring 30 is a modified form of the ring 17 where the inner portion 31 has a more extended taper which shape may be more desirable for knobs where a smaller elastomer ring 15 diameter is used with knobs as shown in FIGS. 5 and 6.

Although the adapter 10 has been described as being made of a plastic, it will be apparent that other materials such as a metal may be used. The lever 23 is generally made of a light-weight material to minimize the weight of the counterbalance where such is needed. It will also be apparent that the split ring 17, 30 may also be formed as an incomplete ring with a gap large enough to slip over the neck 16 of the knob. It is also apparent that the split ring 17 need not have alignment pins 18 if the inconvenience of their absence is acceptable to the installer. It will be further recognized that the ring 17 may have an internal thread and the cylinder an external thread if desired. Of course in that case, ring 17 would require a collar which would squeeze ring 15 against knob 13.

It is understood that the above-described embodiments of the invention are illustrative only and that modifications thereof may occur to those skilled in the art. Accordingly, it is desired that this invention is not to be limited to the embodiments disclosed herein but is to be limited only as defined by the appended claims.

What is claimed is:

1. An adapter for providing a handle to a round door knob having a supporting shaft comprising, an internally threaded cylinder, a collar on one end said cylinder, said cylinder adapted to pass over said knob until stopped by said collar, said cylinder having a handle extending transversely to the cylinder axis, an externally threaded pressure ring adapted to be screwed into said internally threaded cylinder, said ring also being adapted to be rotated about said supporting shaft and screwed into said internally threaded cylinder after said knob is within said cylinder to cause said cylinder to be frictionally attached to said knob and to have a fixed positive relation to said knob and to allow said knob to be turned by said handle attached to said cylinder.

2. The adapter of claim 1 wherein said externally threaded pressure ring is split longitudinally to form at least two partial rings, each of said partial rings being provided with means for screwing said partial rings about the shaft into said internally threaded cylinder.

3. The adapter of claim 2 wherein said partial rings are provided with means to axially align said partial rings to align the threads thereof when said partial rings surround said knob supporting shaft.

4. The adapter of claim 1 further means attached to said cylinder for counterbalancing the turning torque exerted by the weight of said handle.

5. The adapter of claim 1 wherein said pressure ring is provided with means at one end of said ring suitable for engagement to a device for applying torque to said ring.

6. The adapter of claim 1 wherein said ring comprises a pair of externally threaded semi-rings, means for engaging said semi-rings to cause their threads to be aligned to form a continuous thread, an axially directed hole in the end of each insert suitable for engagement with a spandrel wrench.

7. The adapter of claim 1 wherein said ring comprises a pair of externally threaded semi-rings, said semi-rings being adapted to engage each other to cause the ring assembled by such engagement to have a continuous thread, each said semi-ring being adapted to be engaged by a disengageable lever used for tightening said ring in said cylinder.

8. The adapter of claim 1 further comprising a gasket material placed on at least one side of said knob to make frictional engagement between said knob and the adapter.

9. The adapter of claim 8 wherein said gasket material is compressible and has a high coefficient of friction.

10. The gasket material of claim 9 comprising an elastomer.

11. The adapter of claim 1 wherein said collar is an externally thread ring adapted to thread into the cylinder.

12. The adapter of claim 11 wherein said threaded collar extends radially inward and axially inward toward said knob.

13. The adapter of claim 11 wherein said threaded collar extends radially inward and axially outward from said knob.

14. An adapter for providing a lever to a round door knob having a supporting neck comprising, a threaded cylinder, a collar on one end of said cylinder, a first frictional material within said cylinder and against said collar, said cylinder adapted to pass over said knob until stopped by said first material, said cylinder having a lever extending transversely to the cylinder axis, a threaded ring, a second frictional material within said cylinder and against said threaded ring, said ring being adapted to be placed around and rotated about said neck, said ring being threadedly engaged to said cylinder, said first and second frictional materials adapted to be compressed against opposite faces of said knob by said ring and said collar to allow said adapter to have a fixed position on said knob and to allow said knob to be turned by said lever attached to said cylinder of said adapter.

15. An adapter for providing a handle to a door knob having a supporting shaft comprising, a threaded cap, said cap having an end which is smaller than said knob, said cap being adapted to pass over said knob until stopped by said cap end, said cap having a handle extending transversely to the longitudinal axis of said cap, a threaded pressure ring adapted to be screwed to said threaded cap, said ring also being adapted to be rotated about said supporting shaft and screwed to said threaded cap after said knob is within said cap to allow said cap to be frictionally attached to said knob and to have a fixed positive relation to said knob and to allow said knob to be turned by said handle attached to said cap.

16. The adapter of claim 15 wherein said cap is internally threaded, said pressure ring is externally threaded, and said threaded pressure ring is split longitudinally to form two semicircular rings, each of said semicircular rings being provided with means for screwing said semicircular rings about the shaft into said threaded cap.

17. The adapter of claim 15 wherein said cap is a hollow cylinder having a collar at one end adapted to make frictional contact with said knob.

18. An adapter for providing a handle to a door knob having a supporting shaft comprising, a cap, a collar on one end of said cap, said cap adapted to pass over said knob until stopped by said collar, said cap having a handle extending transversely to the axis of said cap, a pressure ring adapted to pass over and around said supporting shaft, means for securing said ring to said cap after said cap is over said knob and said ring is around said shaft, means for supplying force upon said ring in said axial direction along the direction of said supporting shaft after said knob is within said cap, said cap being adapted to be frictionally attached to said knob by the axial force between said ring and said collar producing said frictional attachment.

* * * * *